US005846116A

United States Patent [19]

DiResta et al.

[11] Patent Number: 5,846,116

[45] **Date of Patent: *Dec. 8, 1998**

[54] SQUEEZABLE PLAYTHING SIMULATING DINOSAUR FIGURE

[76] Inventors: Joseph G. DiResta; James DiResta, both of 1078 W. Broadway, Woodmere, N.Y. 11598; Perry Gargano, 92 Horatio St., #4L, New York, N.Y. 10014

[ * ] Notice: The term of this patent shall not extend beyond the expiration date of Pat. No. 5,577,723.

[21] Appl. No.: 917,532

[22] Filed: Aug. 26, 1997

Related U.S. Application Data

[63] Continuation-in-part of Ser. No. 714,417, Sep. 16, 1996, Pat. No. 5,769,682, which is a continuation-in-part of Ser. No. 543,615, Oct. 16, 1995, Pat. No. 5,577,723.

[51] Int. Cl.[6] ..... A63H 3/28; A63H 3/52; A63H 3/00; A63H 5/00

[52] U.S. Cl. ..... 446/184; 446/267; 446/368; 446/397

[58] Field of Search ..... 446/184, 183, 446/180, 185, 188, 190, 192, 193, 196, 199, 267, 321, 368, 397; 473/571, 594, 609

[56] References Cited

U.S. PATENT DOCUMENTS

| | | | |
|---|---|---|---|
| 2,304,415 | 12/1942 | Lawson, Sr. | 446/188 X |
| 2,888,777 | 6/1959 | Kaplan | 446/183 |
| 3,822,500 | 7/1974 | Ostrander | 446/183 |
| 4,623,319 | 11/1986 | Zaruba et al. | 446/267 |
| 4,761,314 | 8/1988 | Marshall | 466/267 X |
| 4,881,915 | 11/1989 | Liaw | 446/368 X |
| 4,990,119 | 2/1991 | Amici et al. | 446/188 X |
| 5,405,148 | 4/1995 | Cianci | 446/368 X |

FOREIGN PATENT DOCUMENTS

| | | | |
|---|---|---|---|
| 0 079 198 | 5/1983 | European Pat. Off. | 446/483 |
| 2 068 753 | 8/1981 | United Kingdom | 446/490 |
| 2 215 226 | 9/1989 | United Kingdom | 446/368 |

*Primary Examiner*—Robert A. Hafer
*Assistant Examiner*—D. Neal Muir
*Attorney, Agent, or Firm*—Michael Ebert

[57] ABSTRACT

A squeezable plaything which simulates a miniature dinosaur figure and when squeezed and released, then generates gurgling sounds suggestive of dinosaur activity. The plaything comprises a generally spherical outer shell formed of flexible transparent plastic film encasing a hollow inner core having an orifice which renders it collapsible. The hollow core is molded of resilient plastic material contoured to simulate a dinosaur in a fetal position assuming an overall ovoid form that fits into the spherical shell. Injected into the air-filled core through the orifice is a charge of oil. When the ball is squeezed and deformed, oil and air are then discharged from the orifice into the confined spaces between the core and shell, and when the ball is then released to recover its normal shape, oil and air are then sucked back into the core, these actions producing the gurgling sounds.

9 Claims, 1 Drawing Sheet

SQUEEZABLE PLAYTHING SIMULATING DINOSAUR FIGURE

RELATED APPLICATIONS

This application is a continuation-in-part of the Joseph G. DiResta et al. application Ser. No. 08/714,417 now U.S. Pat. No. 5,769,682, filed Sep. 16, 1996 entitled "SQUEEZABLE TOY PLAYTHING SIMULATING HUMANOID FIGURE," which in turn is a continuation-in-part of a parent application Ser. No. 08/543,615, filed Oct. 16, 1995 now Pat. No. 5,577,723, the entire disclosures of which are incorporated herein by reference.

BACKGROUND OF INVENTION

1. Field of Invention

This invention relates generally to squeezable toy playthings, and more particularly to a ball-like plaything of this type which simulates a miniature dinosaur figure, and when squeezed and released, generates gurgling sounds suggestive of dinosaur activity.

2. Status of Prior Art

The Osher et al. Pat. Nos. 5,026,053 and 4,944,363 disclose squeezable toy balls having a flexible polymer shell encasing a resiliently deformable inner core of highly plasticized material. Because of the nature of the polymeric core, the toy ball has a soft and supple resilient feeling to one who holds and squeezes it.

It is also known to provide toy balls having a humanoid form. Thus the Tarnoff Pat. No. 4,952,190 shows a toy formed from a molded flexible bladder having a humanoid shape, the bladder being filled with a mixture of plastic microspheres and water so that the toy can be thrown or hit, yet can be caught with bare hands. The rubber ball disclosed in the Johns Pat. No. 2,960,794 is molded to include pop out parts which when the ball is squeezed, pop out to create facial features, such as a nose and ears.

The Hoover Pat. No. 2,351,762 discloses a toy having a transparent outer plastic shell enclosing an inner hollow core formed as a plurality of body parts. The British patent 743,653 to Dash shows a hollow toy figure having an orifice which creates a sound when the figure is squeezed.

The concern of the present invention is with a squeezable ball which qualifies as a "gross" toy; that is a toy that is disgusting. However, the fact that the toy may offend the taste of most adults does not detract from its appeal to children, for children are attracted to gross toys as they are to horror movies that are repugnant to many adults.

The above-identified DiResta et al. patent application, now Pat. No. 5,577,723 discloses a "gross" toy in the form of a squeezable playball in which a collapsible hollow core is encased within a transparent shell, the core being molded of resilient plastic material shaped to simulate a human organ or body part, such as intestines.

This hollow core is provided with an orifice to render it collapsible, the air within the core being expelled through the orifice when the core is squeezed. A charge of viscous fluid such as oil is injected into the core through the orifice. When the ball is squeezed to deform it, air and liquid are then discharged through the orifice into the confined spaces between the core and the shell. And when the ball is then released to recover its normal shape, oil and air are then sucked back into the core. These actions produce gurgling sounds suggestive of intestinal activity.

In the co-pending DiResta et al. application entitled "Squeezable Toy Plaything Simulating Humanoid Figure," the hollow core enclosed within a spherical shell is molded to assume the contours of a humanoid or monster-like figure, the behavior of this ball being the same as the ball in the '723 patent.

The squeezable balls disclosed in the DiResta et al. patent and in the co-pending application all qualify as "gross" toys that are somewhat repellant to adults but not to children who are fascinated by the gruesome forms encased in these transparent balls.

The present invention provides balls which are based on the same "gross" toy concept, this concept now being applied to dinosaur figures that children find particularly fascinating. Thus in natural history museums, it is the full scale reconstructions of dinosaurs whose appearances are threatening that attract the greatest crowds of children.

The term "dinosaur" is generic, for it refers to any of the various extinct species of gigantic carnivorous or herbivorous reptiles that existed in the Mesozoic era. The enormously popular motion picture "The Lost World-Jurassic Park" dynamically recreates dinosaurs that existed in the Jurassic period, the second period in the Mesozoic era.

A dinosaur figure does not lend itself to miniaturization so that it can be fitted into a generally spherical shell to create a squeezable ball of the type illustrated in the prior DiResta et al. patent. The normal configuration of a dinosaur is so far removed from that of a spherical shell that it cannot be confined effectively within the shell to create a ball.

A dinosaur form is defined by a crocodile-like head joined by a neck to a torso having clawed forelegs and clawed rear legs extending therefrom, the torso merging with an elongated tail. Should a miniature version of a dinosaur be created in the form of a molded hollow core, in order to encase this elongated core in a spherical shell the shell would have to have a diameter equal to the length of the dinosaur figure. As a consequence, there would be large empty spaces between the irregular surfaces of the elongated dinosaur figure and the uniform surface of the sphere. It would not therefore be possible to create an acceptable squeezable ball.

The present invention takes into account the fact that dinosaurs are reptiles whose females lay eggs that hatch. Within this egg, the tiny dinosaur to be hatched is in a fetal position in which its head is bowed forward, its clawed forelegs and clawed rear legs are drawn in toward the chest, and its tail is curved under the torso.

In this fetal position, the tiny unhatched dinosaur fits snugly within the oval cavity of the egg shell, and assume an overall ovoid form close to that of a sphere. An unhatched dinosaur in this form satisfies the requirements of a squeezable ball in accordance with the invention.

SUMMARY OF INVENTION

In view of the foregoing, the main object of this invention is to provide a squeezable plaything whose appearance simulates that of miniature dinosaur figure to create a "gross" toy.

A significant feature of a "gross" toy, in accordance with the invention is that it is a realistic replica of a dinosaur that has just been or is about to be hatched.

More particularly, an object of the invention is to provide a squeezable plaything of the above type which can be hit or thrown like an ordinary ball, or be used as a finger exerciser, yet when squeezed generates gurgling sounds suggestive of dinosaur activity.

Also an object of this invention is to provide a squeezable toy ball which may be mass produced at low cost, the ball being sturdy and capable of withstanding rough handling.

Briefly stated, these objects are attained by a squeezable plaything which simulates a miniature dinosaur figure and when squeezed and released, then generates gurgling sounds suggestive of dinosaur activity. The plaything comprises a generally spherical outer shell formed of flexible transparent plastic film encasing a hollow inner core having an orifice which render it collapsible. The core is molded of resilient plastic material contoured to simulate a dinosaur in a fetal position assuming an overall ovoid form that fits into the spherical shell.

Injected into the air-filled core through the orifice is a charge of oil or other viscous liquid. When the ball is squeezed and deformed, oil and air then are discharged from the orifice into the confined spaces between the core and shell, and when the ball is then released to recover its normal shape, oil and air are then sucked back into the core, these actions producing the gurgling sounds.

BRIEF DESCRIPTION OF DRAWING

For a better understanding of the invention, as well as further features thereof, reference is made to the detailed description thereof to be read in connection with the annexed drawings wherein.

DESCRIPTION OF INVENTION

First Embodiment

Figure 1:
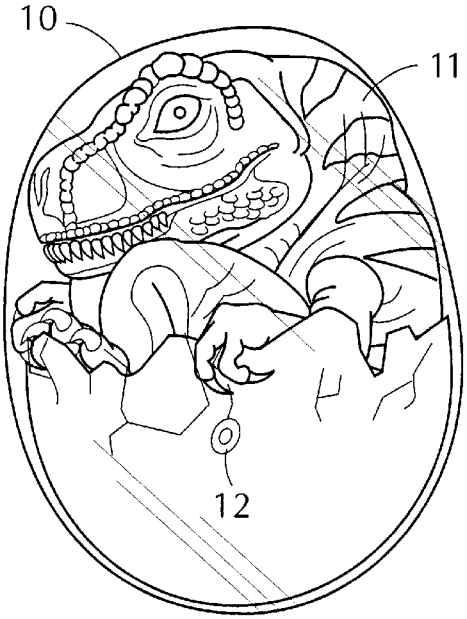
FIG. 1 shows a first embodiment of a squeezable toy ball in accordance with the invention whose transparent outer shell exposes the molded hollow inner core having a dinosaur form encased therein.

Referring now to FIG. 1, there is shown a "gross" toy in the form of a squeezable ball in accordance with the invention, the ball consisting of an outer shell 10 encasing a collapsible hollow inner core 11.

Outer shell 10 which is generally spherical, is made of transparent flexible film of synthetic plastic material of high strength and good clarity, such as silicone plastic, polypropylene or polyethylene. The shell is impermeable to liquids and seals the core encased therein.

Figure 3:
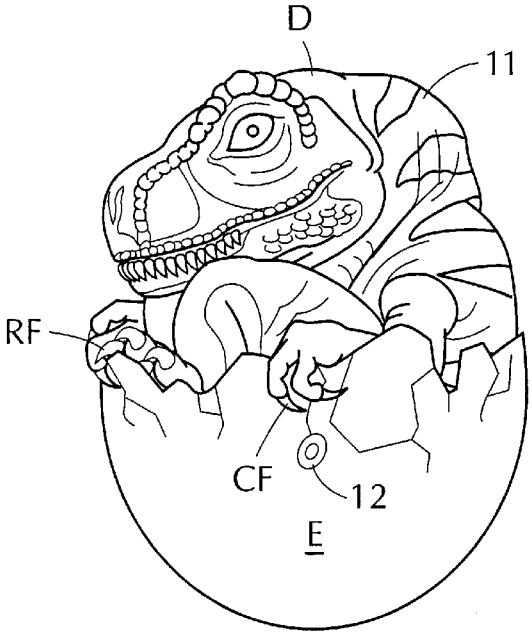
FIG. 3 separately illustrates the molded core of the squeezable toy ball shown in FIG. 1.

Hollow inner core 11, as shown separately in FIG. 3, is molded of resilient synthetic plastic material such as PVC or polyethylene to simulate the appearance of a tiny dinosaur D in the process of being hatched, as it emerges from a cracked egg E. Dinosaur D is in a fetal position, its head being bowed forward and its clawed forelegs and clawed rear legs being drawn toward the chest. However, since the egg is cracked and the dinosaur is emerging from the shell, the claws CF of the forelegs and the claws RF of the rear legs engage the cracked edge of the shell. The purpose of this simulation is to realistically portray the manner in which a dinosaur is hatched.

The overall configuration of the molded dinosaur core 11 is ovoid as is an actual dinosaur egg, and the dimensions of core 11 are such that it fits within the generally spherical shell 10 of the ball, with the major portions of this core making contact with the inner surface of the shell. There are, however, relatively narrow, free spaces between the outer shell 10 and the inner core 11 where the core is recessed or indented to define the shaped form of the dinosaur.

Figure 2:
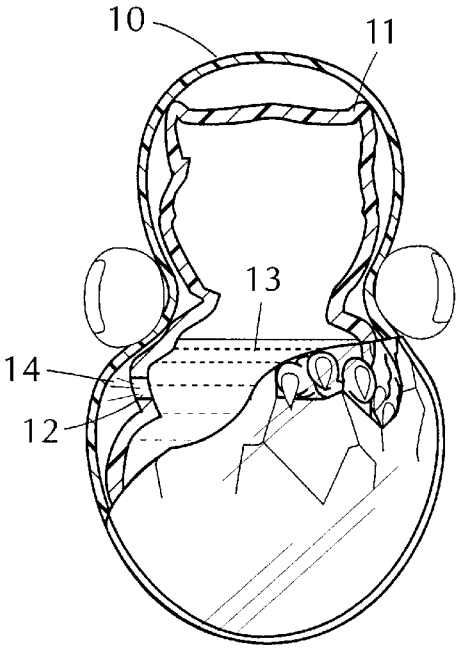
FIG. 2 shows the shape of the ball when it is squeezed.

Injected into air-filled hollow core 11 through orifice 12 is a charge 13 of an inert viscous fluid, such as silicone or mineral oil. When, therefore, the ball is squeezed by a player and deformed, as shown in FIG. 2, the resultant internal pressure causes air and oil to be discharged as a spray 14 from orifice 12 into the confined spaces between the outer surfaces of the core and the inner surface of the shell. When the ball is released to recover its normal form, air and oil are then sucked back through the orifice into the hollow of the shell.

The successive discharge and intake of air and oil produces gurgling sounds which are suggestive of breathing, snorting and other sounds produced by a dinosaur.

The squeezable ball shown in FIGS. 1 and 2 can be used as a finger exerciser rather than as a play ball. The user, by grasping the ball in one hand, can repeatedly squeeze the ball with his fingers and thereby beneficially exercise the finger muscles. In this exercise mode, the gurgling sounds produced each time the ball is squeezed and then released are indicative of this action, for the harder the user squeezes, the louder are the gurgling sounds. In practice, a user may grasp a ball in each hand and simultaneously squeeze both balls.

A dinosaur ball of the type shown in FIG. 1 may be produced in a much smaller scale, such as the squeezable ball having a diameter of about 1.5 inches rather than a playball diameter of about 3 inches. This miniature ball in which is encased a squeezable replica of dinosaur, can serve as a pendant or charm. For this purpose there may be anchored at the upper pole of the ball a post coupled by a chain to a key ring. Or the play ball may be produced in a much larger version, say a ball having a six or eight inch diameter.

Second Embodiment

Figure 4:
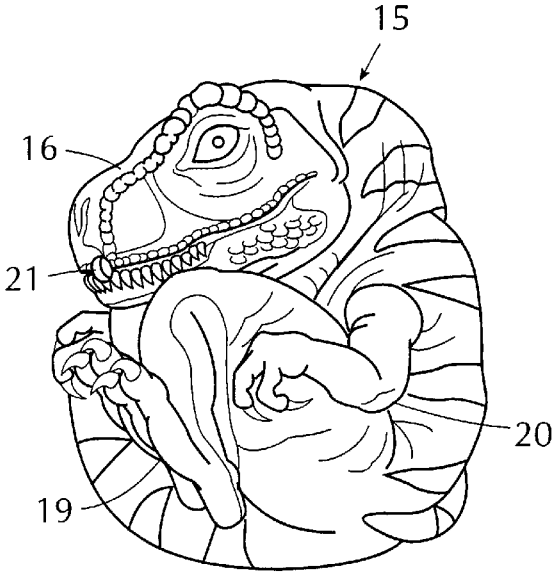
FIG. 4 illustrates a second embodiment a core for a squeezable toy ball.

In the embodiment of the playball, shown in FIG. 4, the molded hollow core 15 is encased in a generally spherical shell, such as shell 10 in FIG. 1. This shell is omitted from FIG. 4. In FIG. 1, the hollow core is molded to simulate a tiny dinosaur in the process of being hatched, the dinosaur emerging from a cracked egg shell.

But in FIG. 4, hollow core 15 is in the form of a dinosaur in the fetal position it assumes within an oval egg shell before the shell is cracked; hence no egg shell is included in this embodiment. The tiny dinosaur in this instance, has a head 16 bowed forward end with large teeth exposed in the open jaws.

The long clawed rear legs 19 are folded in against the chest, and the short clawed forelegs 20 and pressed against the haunches. Hence the overall configuration of this dinosaur in the fetal position is ovoid and fits comfortably within the generally-spherical shell of the ball. Orifice 21 in this instance is at the mouth between the jaws of the dinosaur; hence when the ball is squeezed and viscous fluid intermingled with air is discharged from the orifice, the discharge is from the mouth of the dinosaur, and the resultant gurgling sounds simulate coarse breathing activity. In practice, the viscous fluid or mineral oil may be dyed red and thereby given a blood color to render this activity more gruesome.

While there has been shown and described preferred embodiments of a squeezable plaything simulating dinosaur figures, it will be appreciated that many changes and modifications may be made therein without, however, departing from the essential spirit thereof.

We claim:

1. A squeezable plaything comprising:

A. a globular outer shell formed of flexible transparent plastic film;

B. a hollow, air-filled core encased in the shell having an orifice therein to render the core collapsible, said core being molded of resilient plastic material contoured to define a miniature dinosaur figure which is entrapped within the shell; and C. a charge of viscous liquid injected into said core through the orifice whereby when the plaything is squeezed to deform the figure, air intermingled with liquid is discharged through said orifice into a confined space between said core and said shell, and when the plaything is then released to cause the figure to resume its normal form, air and liquid are then sucked back into the core, these actions generating gurgling sounds suggestive of dinosaur activity.

2. A plaything as set forth in claim 1, in which the plaything has the dimensions of a playball which can be thrown and caught.

3. A plaything as set forth in claim 1, in which the plaything has a diameter of about 1.5 inches to provide a pendant.

4. A plaything as set forth in claim 1, in which the viscous fluid is silicone oil.

5. A plaything as in claim 1, in which the miniature dinosaur figure is in a fetal position whereby the overall configuration of the dinosaur is ovoid.

6. A plaything as set forth in claim 5, in which the dinosaur figure is in a simulated partially cracked egg to simulate hatching.

7. A plaything as set forth in claim 1, in which the orifice is at a jaw position whereby the discharge of liquid and air appears to come from the mouth of the dinosaur.

8. A plaything as set forth in claim 1, in which the shell is formed of polypropylene.

9. A plaything as set forth in claim 1, in which the core is molded of polyvinyl chloride.

* * * * *